US007950739B2

(12) United States Patent
King

(10) Patent No.: US 7,950,739 B2
(45) Date of Patent: May 31, 2011

(54) STADIUM SEAT AND A METHOD OF MOUNTING A STADIUM SEAT

(75) Inventor: Sheldon King, Rose Bay (AU)

(73) Assignee: The Product People Pty Limited, Sydney, NSW (AU)

( * ) Notice: Subject to any disclaimer, the term of this patent is extended or adjusted under 35 U.S.C. 154(b) by 574 days.

(21) Appl. No.: 11/575,117

(22) PCT Filed: Sep. 16, 2005

(86) PCT No.: PCT/AU2005/001420

§ 371 (c)(1),
(2), (4) Date: Dec. 19, 2007

(87) PCT Pub. No.: WO2006/029473

PCT Pub. Date: Mar. 23, 2006

(65) Prior Publication Data

US 2008/0217979 A1 Sep. 11, 2008

(30) Foreign Application Priority Data

Sep. 17, 2004 (AU) ..... 2004905383
Sep. 17, 2004 (AU) ..... 2004905384

(51) Int. Cl.
*A47C 15/00* (2006.01)
*A47C 1/08* (2006.01)

(52) U.S. Cl. ..... 297/333; 297/335; 297/248; 297/252

(58) Field of Classification Search ..... 297/331, 297/332, 333, 335, 440.15, 249, 252
See application file for complete search history.

(56) References Cited

U.S. PATENT DOCUMENTS

| | | | | | |
|---|---|---|---|---|---|
| 227,832 | A | * | 5/1880 | Porter | 297/252 |
| 974,703 | A | * | 11/1910 | Parr | 297/332 |
| 1,029,821 | A | * | 6/1912 | Patterson | 248/240 |
| 2,913,039 | A | * | 11/1959 | Mauser | 297/249 |
| 3,002,787 | A | * | 10/1961 | Ziegenfuss | 297/249 |
| 3,230,005 | A | * | 1/1966 | Staples | 297/160 |
| 3,351,377 | A | * | 11/1967 | Anderson | 297/162 |

(Continued)

FOREIGN PATENT DOCUMENTS

DE 296 16 800 U1 11/1996

(Continued)

OTHER PUBLICATIONS

The Supplemental European Search Report issued in related European Application No. 05784639.6.

(Continued)

*Primary Examiner* — Sarah B McPartlin
(74) *Attorney, Agent, or Firm* — Connolly Bove Lodge & Hutz LLP

(57) ABSTRACT

A seat (1, 41, 61) for stadia, auditoria and the like is disclosed. The seat has a fixed backrest (2, 42) pivotable between a horizontal use position and a vertical standby position. A spring (33) or other resilient means urges the seat (5, 45) into the standby position. A damping mechanism such as a viscous grease damps the motion, preferably in both directions. Mounting straps (51, 52, 71, 72) enable a body (45) to be clamped to a spine (7, 47). By lightly tightening the straps, the position of the seat on the spine can be subject to small final adjustments before final tightening.

6 Claims, 11 Drawing Sheets

U.S. PATENT DOCUMENTS

| | | | | | |
|---|---|---|---|---|---|
| 3,690,726 | A | * | 9/1972 | Van Ryn | 297/332 |
| 3,762,765 | A | * | 10/1973 | Piretti | 297/162 |
| 3,885,766 | A | * | 5/1975 | Resch et al. | 248/188.1 |
| 4,277,101 | A | * | 7/1981 | Vogel | 297/232 |
| 4,730,873 | A | * | 3/1988 | Janz | 297/452.14 |
| 4,850,159 | A | | 7/1989 | Connor | |
| 5,257,852 | A | | 11/1993 | Tsuneki et al. | |
| 5,328,231 | A | | 7/1994 | Raymond | |
| D439,428 | S | * | 3/2001 | Mizuno | D6/368 |
| 6,296,315 | B1 | * | 10/2001 | Jensen | 297/452.14 |
| 7,204,553 | B2 | * | 4/2007 | Olarte | 297/332 |

FOREIGN PATENT DOCUMENTS

| | | | |
|---|---|---|---|
| EP | 0367900 | A1 | 5/1990 |
| EP | 0576746 | A1 | 1/1994 |
| EP | 1166683 | A1 | 1/2002 |
| FR | 2 237 411 | A | 2/1975 |
| GB | 1 441 822 | A | 7/1976 |
| GB | 2 247 496 | A | 3/1992 |
| GB | 2 302 504 | A | 1/1997 |
| JP | 11-178669 | | 7/1999 |
| JP | 2003 19847 | A | 1/2003 |
| WO | WO-00-56190 | | 9/2000 |
| WO | WO-01-21043 | A1 | 3/2001 |

OTHER PUBLICATIONS

International Search Report No. PCT/AU2005/001420, dated Oct. 25, 2005, 5 pages.

* cited by examiner

STADIUM SEAT AND A METHOD OF MOUNTING A STADIUM SEAT

FIELD OF THE INVENTION

The present invention relates to stadium seating and, in particular, to the reduction of undesired noise in stadium seats and to a stadium seat mounting arrangement.

BACKGROUND ART

Stadium seats generally take the form of a fixed backrest and a pivotably mounted seat. The seat is pivotable between a substantially vertical standby position and a substantially horizontal use position. A resilient member such as a spring or an elastomeric equivalent, is interposed between the seat and backrest and urges the seat into the standby position. Thus when a spectator arrives at a stadium, it is necessary for him to manually move the seat into the horizontal position against the urging of the resilient member in order to sit on the seat. Such an arrangement has the very desirable advantage that when the spectators leave, the seats are automatically returned to the standby position and thus do not reduce the width of the aisle between adjacent rows of seats and along which the spectators move.

However, an unintended consequence of the movement of the seat is that the seat and backrest (which are generally moulded from plastics material) make a noise caused by the seat hitting the backrest (or a stop protrusion for the seat) as the seat returns to its standby position.

As a result, at the end of a performance, for example, as the spectators or patrons all rise from their seats, a volley of staccato like banging noises echoes throughout the auditorium. A similar problem arises where such seats are used for an orchestral auditorium, for example. Should an attendee rise to his feet, the sound of the seat hitting the backrest, or stop, disturbs the performance.

It is known to reduce this problem by the provision of an elastomeric pad or similar compressible body to be positioned on either the seat or the backrest, or both; the intention being to cushion the impact of the seat on the backrest and thereby reduce the noise to a tolerable level. The disadvantage of this stratagem is that the elastomeric pad is not inexpensive and thus the overall cost of the seating arrangement is increased. Also the softer the pad, the better the sound suppression, but the shorter the operating life of the pad.

Another problem that appears in stadium seating arises due to repeated manual movement of the seat back and forth into and out of its standby position. Particularly where the seat makes a noise as it hits the backrest on reaching the standby position, it is known for seated spectators to provide a loud clapping noise by manually moving an adjacent empty seat into and out of the standby position rapidly in order to barrack for their side or generally create a mechanical applause effect. Similarly, it is also known for vandals simply to wantonly destroy stadium seats merely by repeatedly moving the seat into and out of the standby position thereby causing accelerated wear and tear with consequent damage.

In many stadia and auditoria, a horizontal spine extends in the row direction between adjacent aisles. The individual seats are connected to the spines after the spines have been erected. In one style of mounting, the spines are provided with welded metal attachments to which the stadium seats are engaged. In another, the spines are pre-drilled and a fastener is used to secure the stadium seat to the spine. Both of these attachment methods have the disadvantage that fine adjustment of position of the stadium seat is not possible.

In an alternative arrangement, the stadium seat is provided with a body in two parts which are shaped so as to be clamped to the spine. Normally fasteners extend between the two parts and these can be tightened to increase the clamping action. By loosely attaching the stadium seats to the spine, it is possible for the each seat's final position to be determined with precision. This is normally done by setting the spacing of the seats in the front row, and then setting the spacing of the seats in the second row so that the seats in the second row fall in between the seats in the first row. This procedure is repeated for each row in turn.

OBJECT OF THE INVENTION

It is an object of the present invention to provide an alternative arrangement which substantially overcomes or at least ameliorates the abovementioned noise problem. It is also an object of the present invention to provide an advantageous system of connecting the stadium seats to the spine and, in particular, in a low cost manner.

SUMMARY OF THE INVENTION

In accordance with a first aspect of the present invention there is disclosed a seating arrangement for stadia, auditoria, and the like, said arrangement comprising a fixed backrest, and a seat having a pivotal mounting including a resilient means interposed between said seat and backrest to permit said seat to be pivoted between a substantially vertical standby position, to which said resilient means returns said seat, and a substantially horizontal use position into which a user manually moves said seat against the urging of said resilient means, wherein said pivotable mounting includes a damping means to slow the movement of said seat between said use and standby positions.

In accordance with a second aspect of the present invention there is disclosed method of reducing undesired noise in the seating arrangements of stadia, auditoria, and the like, said method comprising the steps of:

(i) pivotally mounting a seat relative to a fixed backrest and providing resilient means interposed between said seat and backrest to permit said seat to be pivoted between a substantially vertical standby position, to which said resilient means returns said seat, and a substantially horizontal use position into which a user manually moves said seat against the urging of said resilient means, and (ii) providing said pivotal mounting with a damping means to slow the movement of said seat between said use and standby positions.

The abovementioned damping arrangement provides the unexpected benefit that spectators wishing to create a mechanical applause effect, or vandals wishing to cause damage to the seating arrangement, quickly become bored because of the extra mechanical effort involved in moving the seat into and out of the seating arrangement against the action of the damping provided as referred to above. As a consequence, this essentially anti-social behaviour quickly comes to an end and the problem is solved or at least ameliorated.

In accordance with a third aspect of the present invention there is disclosed a mounting system for connecting stadium seats to a horizontally extending spine, said system comprising an elongate body, a backrest extending from said body, and a seat pivotally mounted from said body and pivotable with respect to said body and backrest, wherein that portion of said elongate body facing away from said backrest is shaped to mate with an upper region of said spine but not extend beyond a lower region of said spine, and at least one substantially inextensible strip extends around said mated body and spine to clamp said body to said spine.

In accordance with another aspect of the invention there is provided a method of connecting stadium seats to a horizontally extending spine, said method comprising the steps of:

providing an elongate body;

providing a backrest extending from said body;

pivotally mounting a seat from said body such that said seat is pivotable with respect to said body and backrest;

shaping that portion of said elongate body facing away from said backrest to mate with an upper region of said spine but not extend beyond a lower region of said spine; and disposing at least one substantially inextensible strip around said mated body and spine to clamp said body to said spine.

BRIEF DESCRIPTION OF THE DRAWINGS

Preferred embodiments of the present invention will now be described, by way of example only, with reference to the accompanying drawings in which.

DETAILED DESCRIPTION

Figure 1:
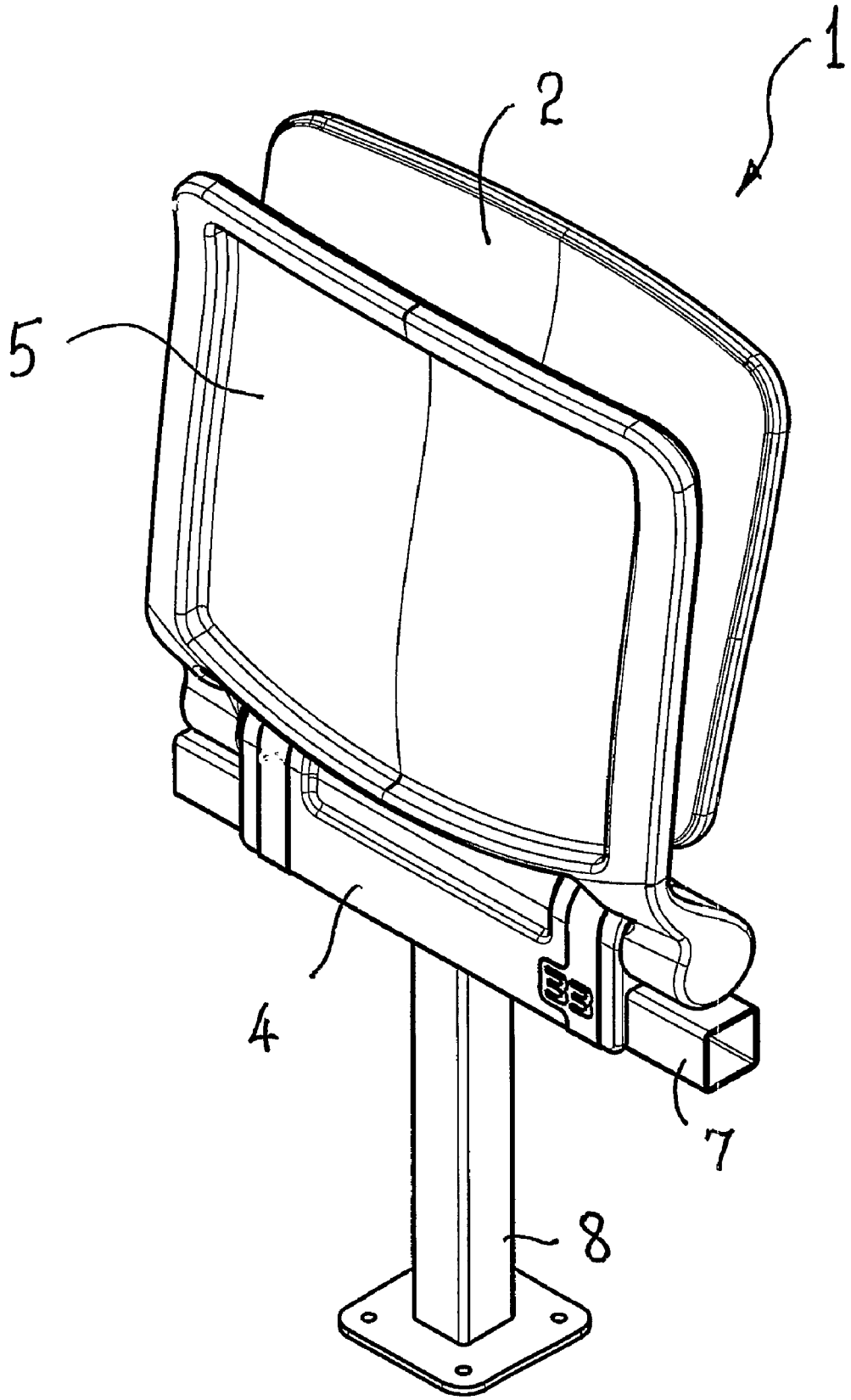
FIG. 1 is a front perspective view of the stadium seat of a first embodiment with the seat in the substantially vertical standby configuration.
Figure 2:
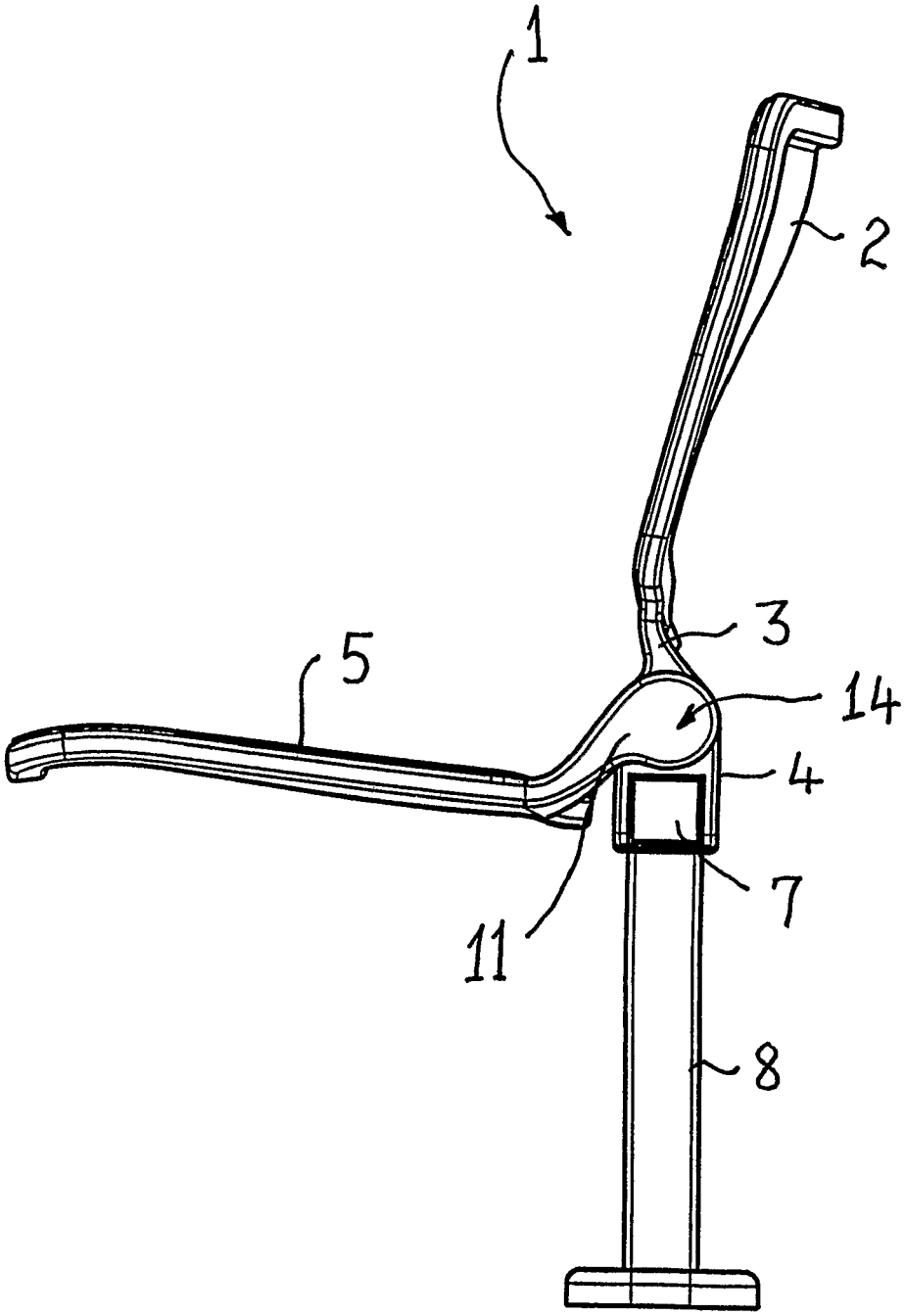
FIG. 2 is a left side elevation of the seat of FIG. 1 with the seat in the substantially horizontal use configuration.
Figure 3:
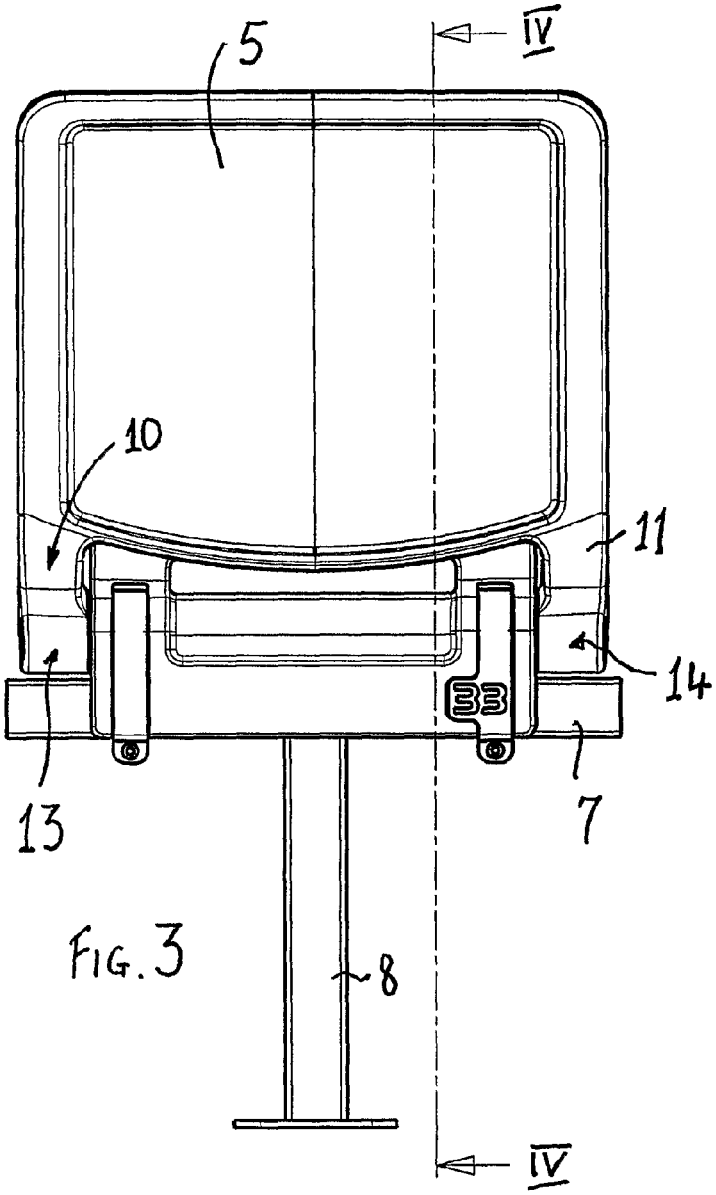
FIG. 3 is a front elevation of the seat of FIG. 1.
Figure 4:
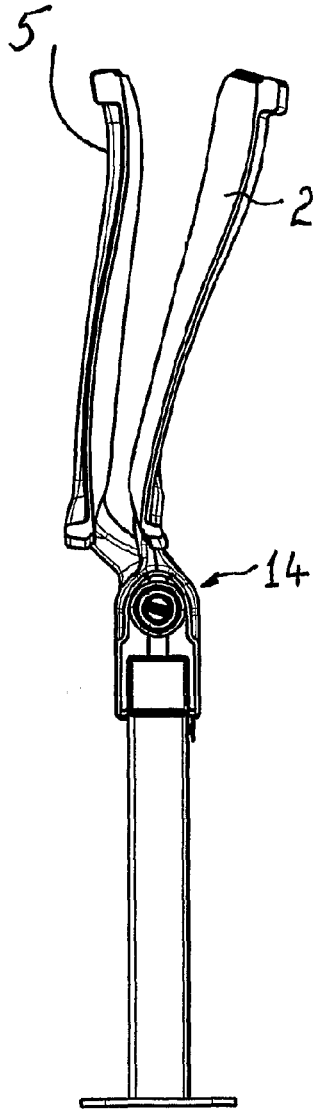
FIG. 4 is vertical cross section taken along the line IV-IV of FIG. 3.

As seen in FIGS. 1-3, the stadium seat 1 of the first embodiment has a backrest 2 supported by a pair of upstands 3 which extend from a central elongate body 4. Pivoted to the elongate body 4 is a seat 5 which in FIGS. 1 and 3 is in the substantially vertical standby configuration and in FIG. 2 is in the substantially horizontal use configuration. The central body 4 is supported by a spine 7 which is in turn mounted on a leg 8.

Figure 6:
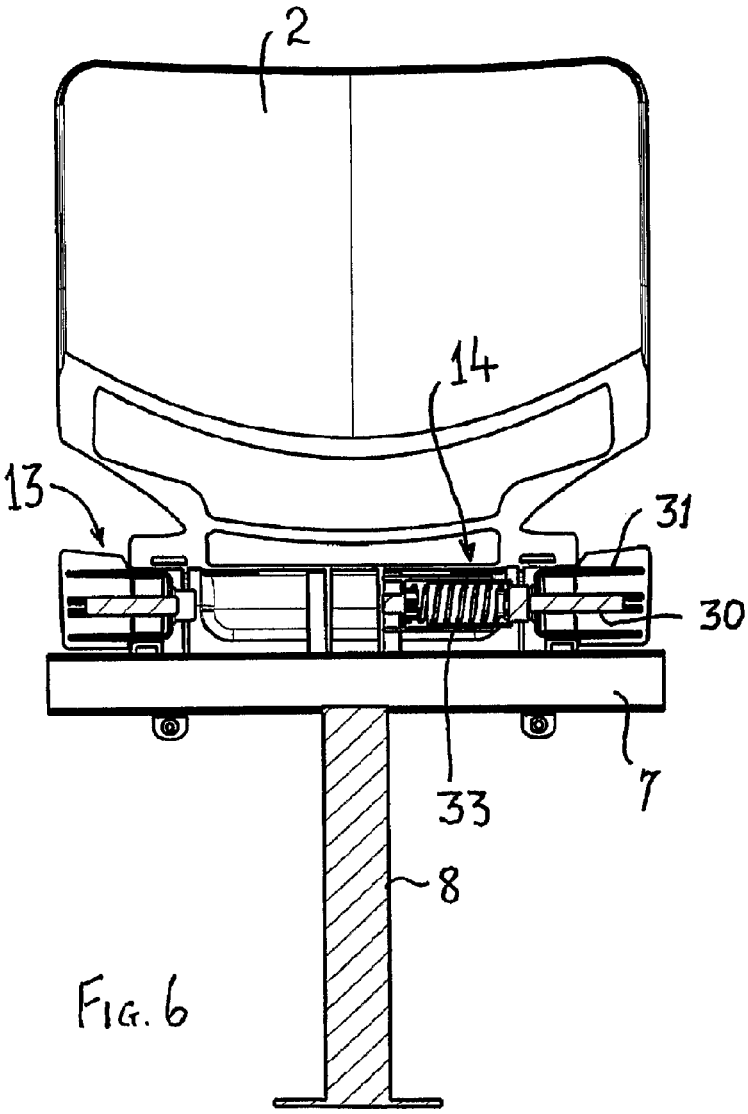
FIG. 6 is a vertical cross section taken on the line VI-VI of FIG. 5.
Figure 5:
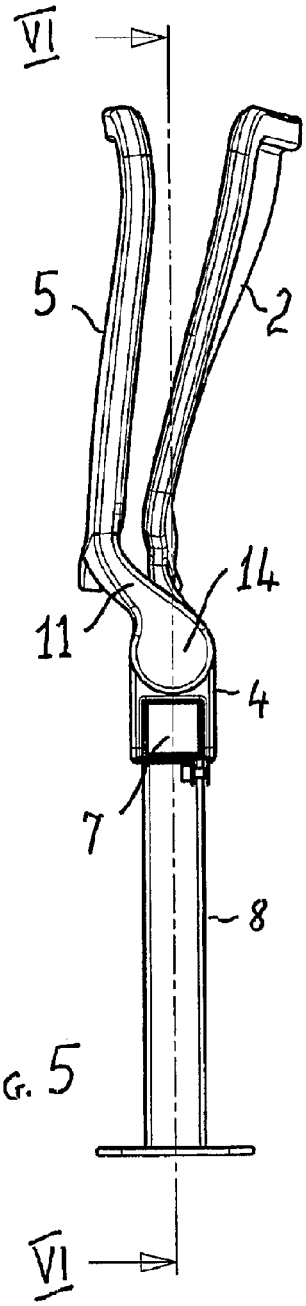
FIG. 5 is a view similar to FIG. 2 but showing the seat in the standby configuration.

As best seen in FIG. 3 and 6, the seat 5 is provided with a pair of arms 10, 11 which are rotatably supported by the central body 4. As best appreciated from FIG. 6, the right hand pivotable mounting between the central body 4 and the arm 5 is a straightforward rotary mounting and is different from the left hand rotary mounting 14 which includes both a resilient interconnection between the seat 5 and the central body 4 and a damping mechanism.

Figure 7:
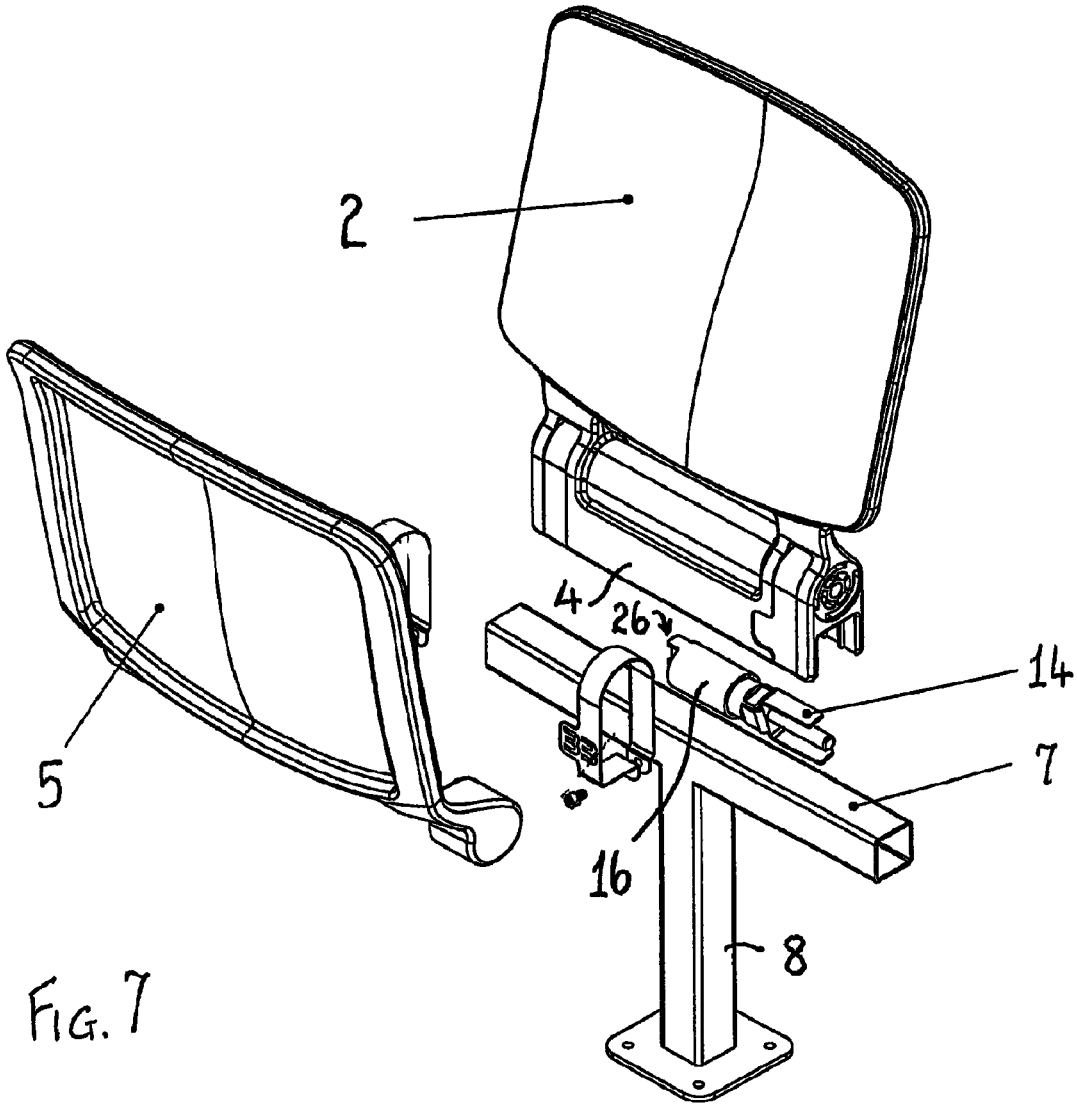
FIG. 7 is an exploded perspective view of the seat in the configuration illustrated in FIG. 1.
Figure 8:
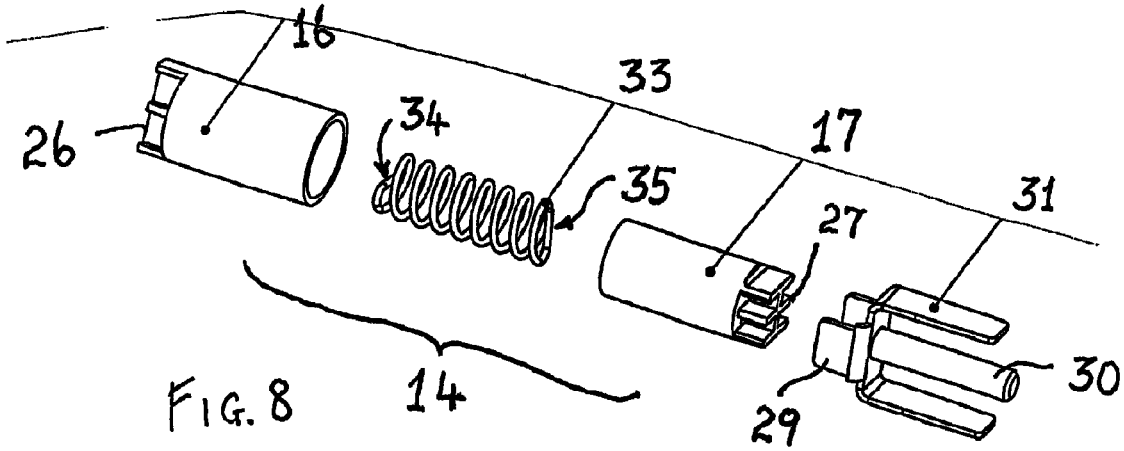
FIG. 8 is an exploded perspective view of the components of the damped pivotable mounting mechanism.

The details of the rotary mounting 14 are best appreciated from FIGS. 6, 7 and 8 and take the form of a first barrel 16 which includes a locating lug 26 which engages with the central body 4 and prevents rotation of the first barrel 16 about its longitudinal axis. The rotary mounting 14 also includes a second barrel 27 which, like the first barrel 16, is essentially a hollow tube closed at one end. The second barrel 17 has a plurality of mounting lugs 27 at its closed end which engage with protrusions 29 on a stub axle 30. The stub axle 30 also includes a pair of prongs 31 which engage with the arm 11 of the seat 5.

Positioned in between the first barrel 16 and second barrel 17 is a helical compression spring 33 each end of which is formed into a transverse member 34, 35. The interior of each of the first barrel 16 and second barrel 17 is provided with a respective slot (not illustrated) which engages the corresponding transverse member 34, 35 when the spring 33 is located within the second barrel 17 and the second barrel 17 is located within the first barrel 16.

Thus with reference to FIG. 8, the prongs 31 can be rotated in an anti-clockwise direction in order to compress the spring 33 and pivot the seat 5 out of the standby configuration. The energy stored in the spring 33 returns the seat 5 to the standby configuration when a force is no longer applied to the seat 5 to urge it into the substantially horizontal use position.

In order to damp the motion, the interior of the second barrel 17 is filled with a high viscosity liquid, such as grease, prior to insertion of the spring 33 therein. As a consequence, when the spring 33 is inserted into the second barrel 17, the grease fills the spaces between the various turns of the spring 33. Furthermore, when the second barrel 17 is positioned within the first barrel 16, some of the grease also is positioned on the mating cylindrical bearing surfaces of the first and second barrels. The result of the grease is that rotational movement between the first and second barrels 16, 17—in both directions—is damped. Similarly, compressing and uncompressing the spring 33 is also damped since this requires movement of the grease in order for the spring 33 to change shape. The grease is sufficiently viscous not to be discharged from the combination of the two barrels and thus remains in situ for the operating life of the chair.

The preferred form of damping liquid is polydimethylsiloxane which is a silicone grease having a viscosity of at least approximately 30,000 csp (and preferably up to 60,000 csp) such as that sold under the trade name SIL GEL or 200 FLUID by the Dow Corning Corporation. An alternative damping liquid is that manufactured by Asia Pacific Speciality Chemicals of Sydney, Australia and sold under the name VACUUM FLUID.

An advantage of the more viscous damping liquid is that the seat also rises slowly. Thus a spectator can jump to his feet with excitement, or to applaud good play, and the sit down again without having to manually lower the seat. This is because the seat has only risen by a small amount. This feature is thought to avoid considerable personal injury problems (and the resulting litigation). However, the seat will rise sufficiently quickly so as not to impede egress at the end of the game (or in the event of fire).

Referring now to FIGS. 9-14, there is shown a stadium seat 41 according to a second embodiment. The seat 41 has a backrest 42 which is supported by two spaced apart vertically extending upstands 43, 44 which extend from a body 45. The upstands 43, 44 define an opening 46 therebetween. The body 45 is elongate and generally U-shaped when viewed in transverse cross section. This is best appreciated from FIG. 11. The U-shaped body 45 mates with a horizontally extending spine 47 which is supported by a number of spaced apart legs 48, only one of which is illustrated in FIGS. 9-12.

Figure 9:
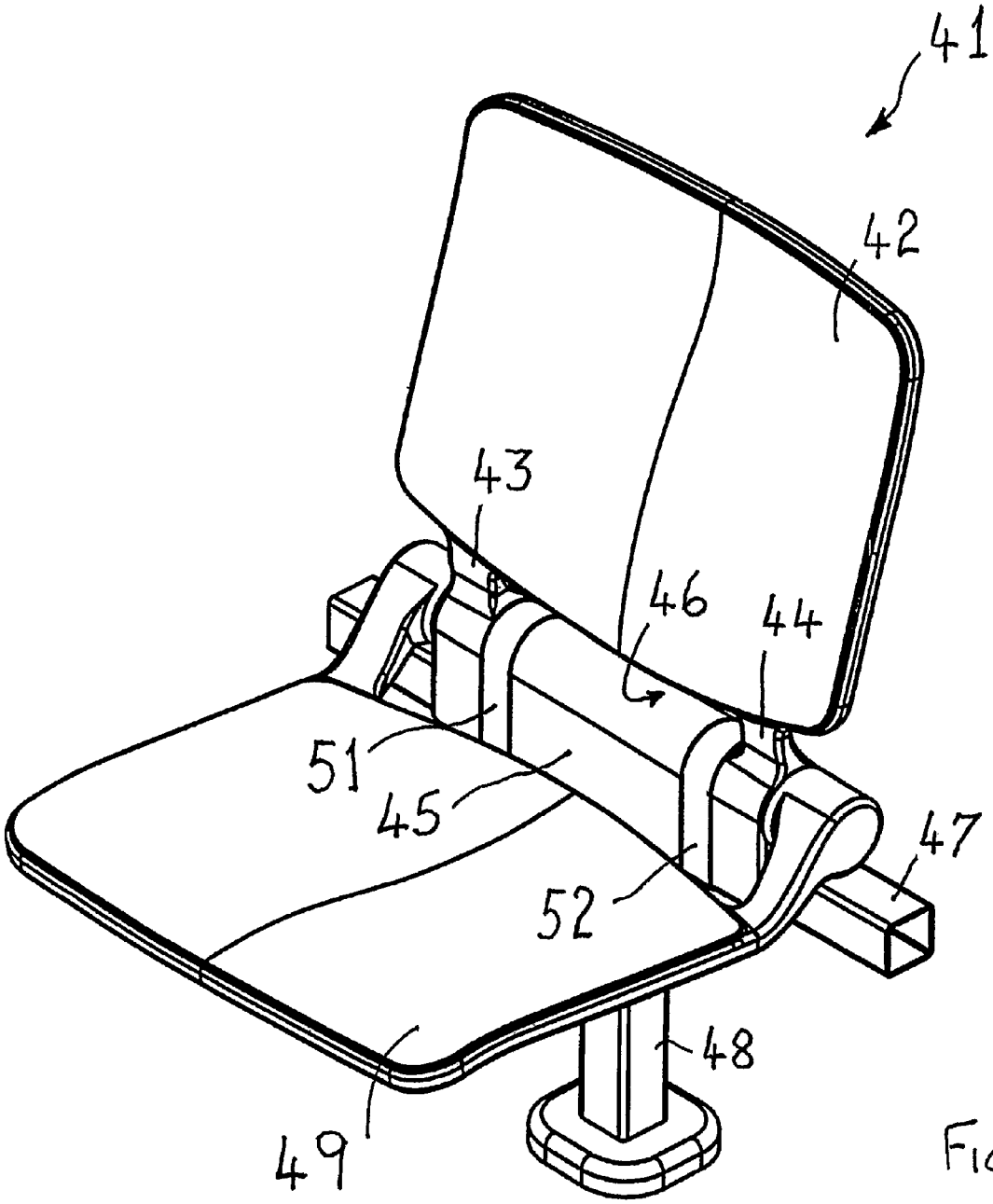
FIG. 9 is a perspective view of the stadium seat of a second embodiment in its use configuration.
Figure 10:
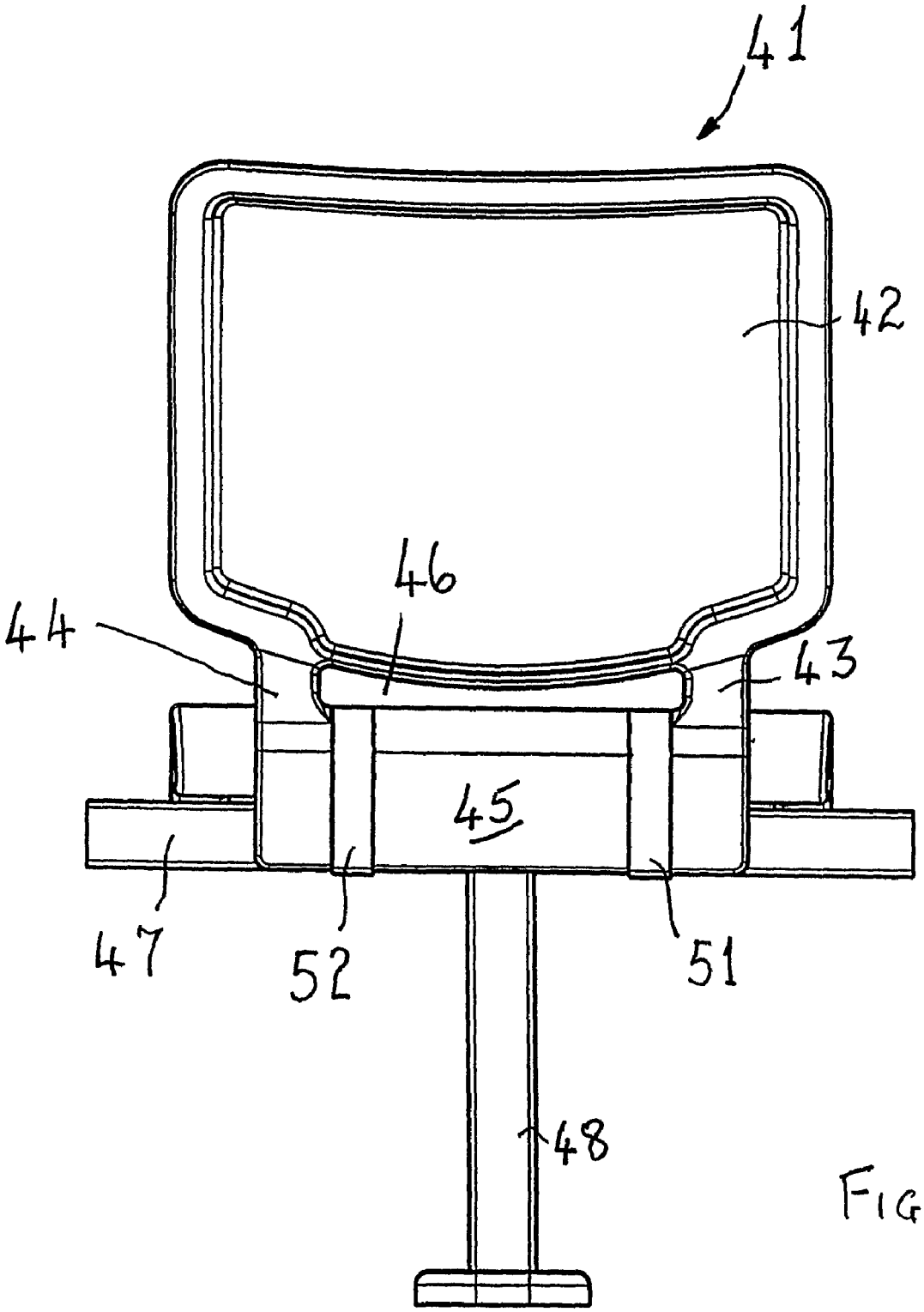
FIG. 10 is a rear elevation of the seat of FIG. 9.
Figure 11:
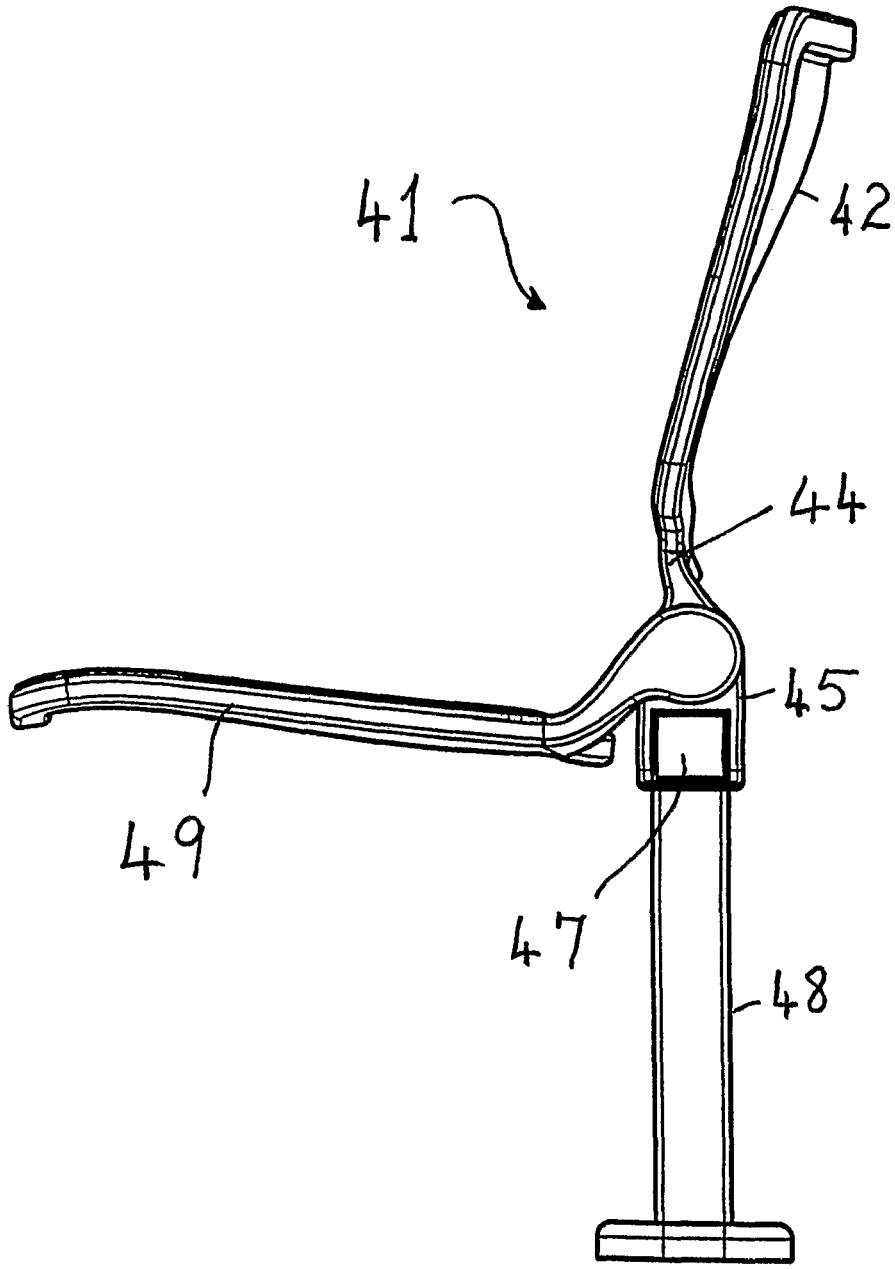
FIG. 11 is a left side elevation of the seat of FIGS. 9 and 10.
Figure 12:
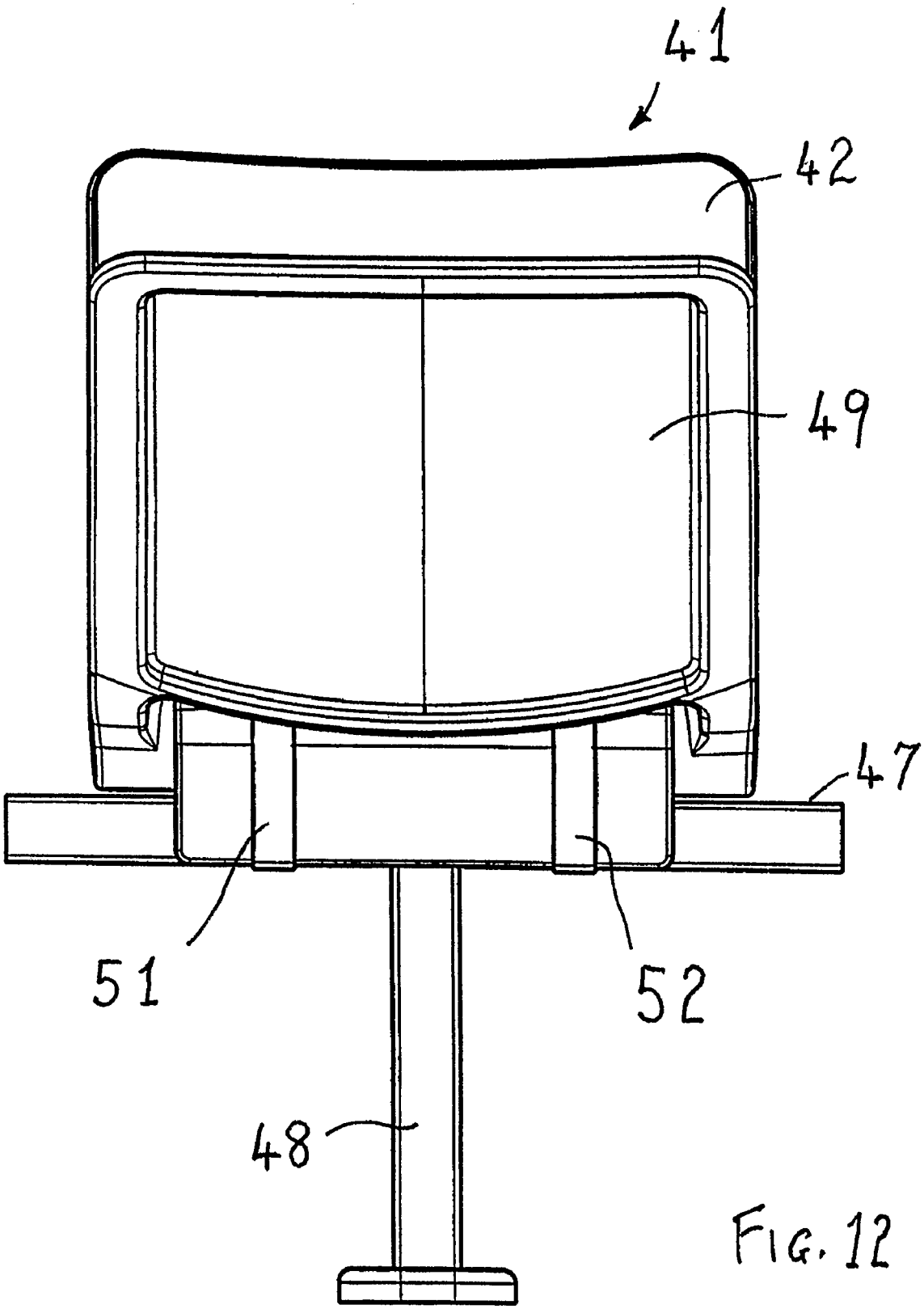
FIG. 12 is a front elevation of the seat of FIGS. 9-11 but showing the seat in the standby configuration.

Pivotably mounted with respect to the body 45 and backrest 42 is a seat 49 which is movable between a substantially horizontal use configuration illustrated in FIGS. 9-11 and a generally vertical standby configuration illustrated in FIG. 12. In order to attach the body 45 to the spine 47 and thereby mount the stadium seat 41, two metal straps 51, 52 extend around the body 45 and the spine 47 passing through the opening 46.

The straps 51, 52 are preferably made of metal and are therefore in practical terms substantially inextensible and can be secured by any known mechanism. A substantial advantage of the straps 51, 52 is that they can be used to initially loosely mount the stadium seat 41 on the spine 47 such that the stadium seat 41 can be slid to the left or right along the spine 47 to determine its final position. Thereafter the straps 51, 52 are tightened to their final state thereby firmly securing the stadium seat 41 to the spine 47.

Figure 13:
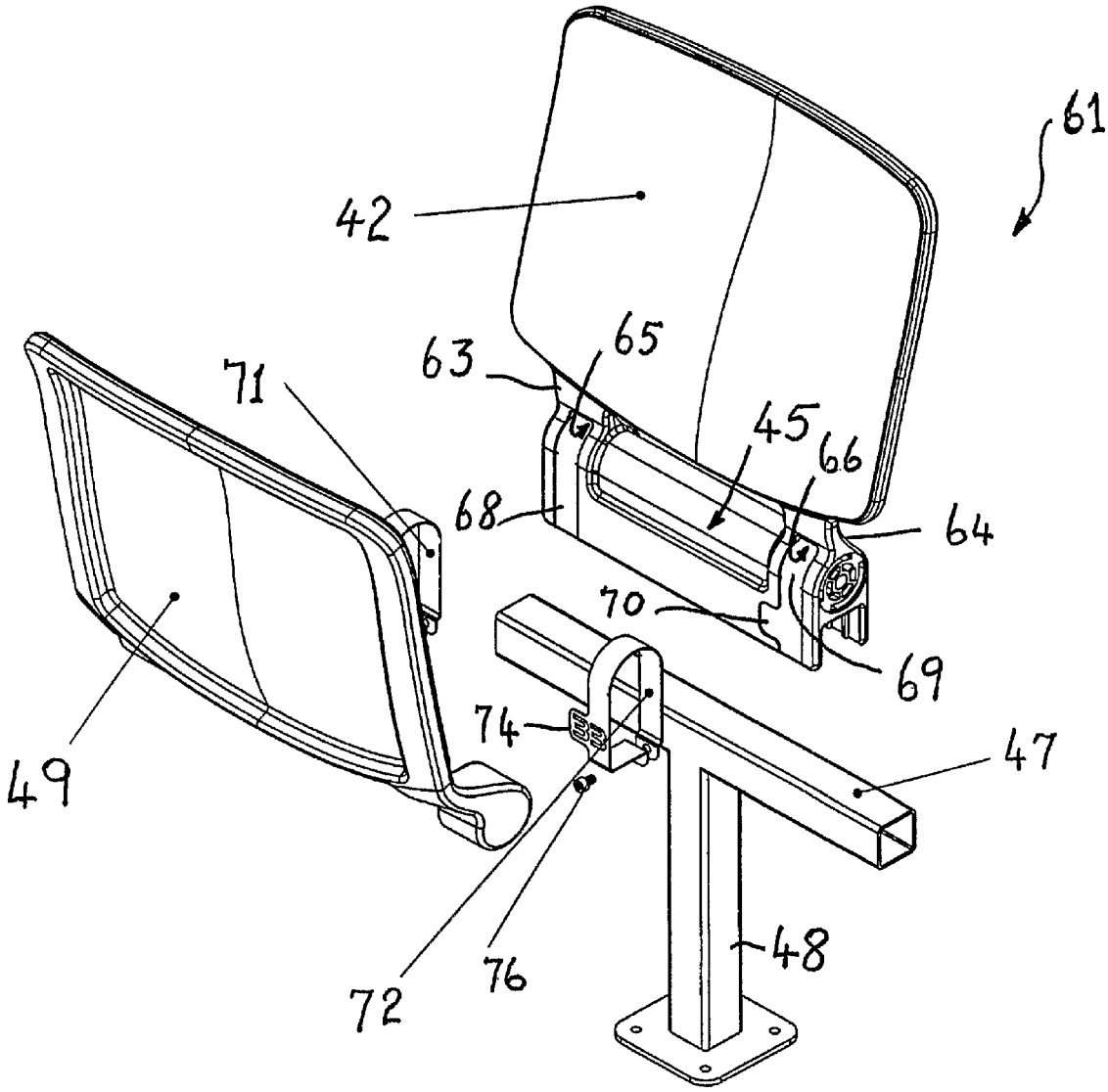
FIG. 13 is an exploded perspective view of a stadium seat of a third embodiment.
Figure 14:
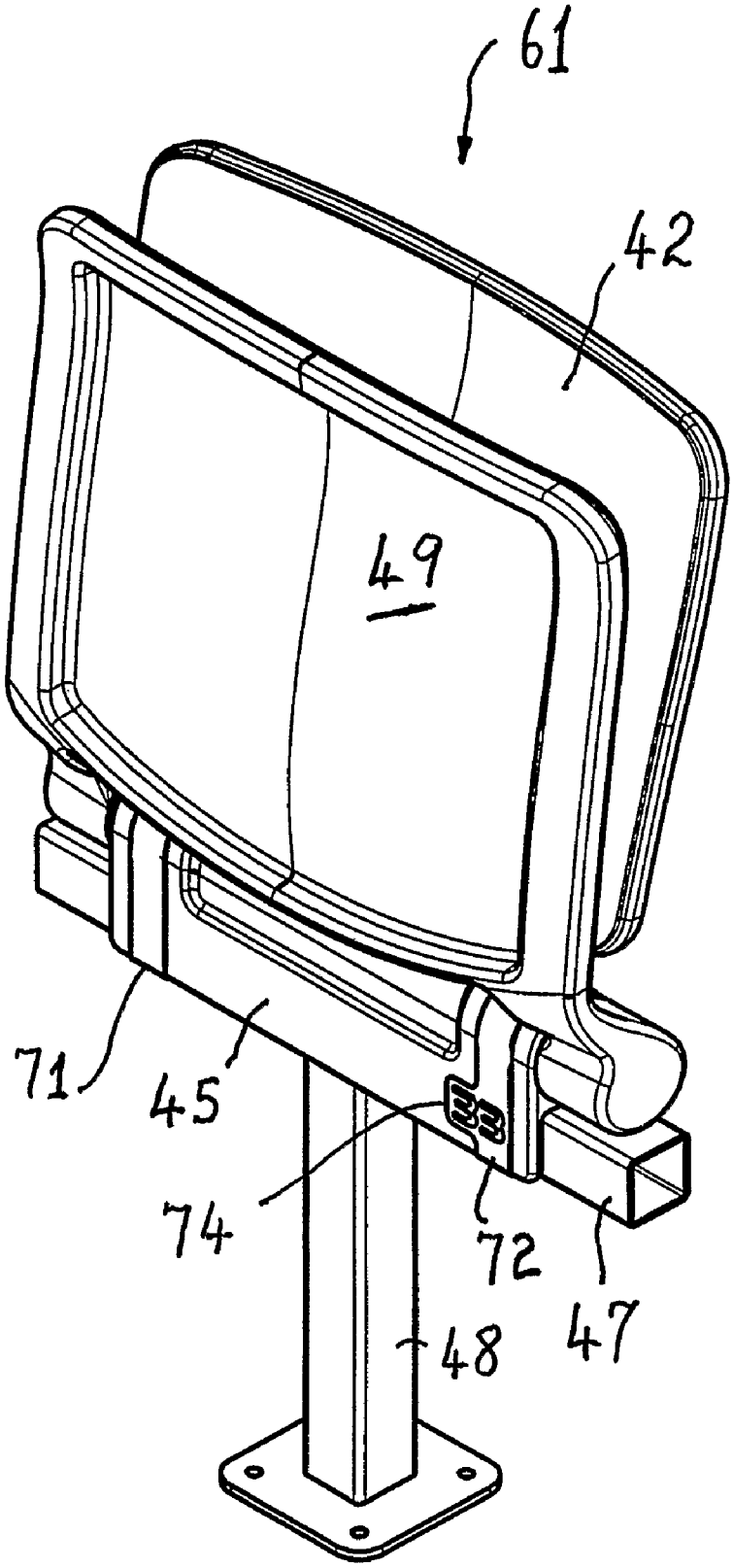
FIG. 14 is a perspective view of the stadium seat of the third embodiment with the seat in the stand by configuration.

In a third embodiment illustrated in FIGS. 13 and 14, the stadium seat 61 has a backrest 42, body 45 and seat 49 essentially as before. The spine 47 and leg 48 are also as before. However, the transverse extent of the upstands 63, 64 is greater in FIGS. 13 and 14 than in FIGS. 9-12. Thus each of the upstands 63, 64 is provided with a corresponding aperture 65, 66. It is through these apertures 65, 66 that corresponding straps 71, 72 pass in order to clamp the body 45 to the spine 47.

It will be seen in FIG. 13 that the body 45 is provided with a straight groove 68 which receives the strap 71 in order to locate same relative to the body 45. At the other end of the body 45 is a similar groove 69 which is provided with a recess 70, the groove 69 accommodating the strap 72 and the recess 70 accommodating an indicium portion 74 of the strap 72. In this way the strap 72 is similarly positively located relative to the body 45. The indicium portion 74 carries a number, in this example the number of the seat 61 in a particular row (number 33) but the indicium portion could in addition indicate the row and seat number such as H42 indicating seat 42 in row H, for example.

Each of the straps 71, 72 is provided with an aperture in one end and a threaded hole in the other end. A fastener in the form of a grub screw 76 is passed through the aperture and is threadably engaged with the threaded hole in order to tighten the strap 71, 72. An initial engagement between the grub screw 76 and the threaded hole is normally sufficient to loosely mount the stadium seat 61 on the spine 47 so that it can thereafter be adjusted into its final position. Then the grub screw 76 is tightened. Preferably the grub screw 76 is provided with a head (known per se) which is only able to be tightened and not untightened. This prevents vandals attacking the mounting arrangement once the seats have been finally positioned.

The foregoing describes only three preferred embodiments of the present invention and modifications, obvious to those skilled in the seating arts, can be made thereto without departing from the scope of the present invention. For example, the straps 51, 52, 71 and 72 can be fabricated from steel or engineering grade plastics material. Stamped metal straps are particularly useful because the seat number can be fabricated during the stamping operation. In addition, other mechanisms besides the grub screw can be used to tighten the straps. For example, radiator hose clamp technology or a toggle arrangement as used for ski boots, is able to be utilized.

The term "comprising" (and its grammatical variations) as used herein is used in the inclusive sense of "including" or "having" and not in the exclusive sense of "consisting only of".

The invention claimed is:

1. A mounting system for connecting stadium seats to a horizontally extending spine, said system comprising:

an elongate body having a backrest extending therefrom and a seat pivotally mounted from said body and able to pivot with respect to said body and backrest, wherein the underside of said body which faces away from said backrest is shaped to engage with, and mate with, an upper region of said spine but not extend beyond a lower region of said spine, and at least one substantially inextensible flexible strip extends entirely around both said spine and mated body and has its opposite ends joined together to strap said body to said spine.

2. The system as claimed in claim 1 wherein for each strip there is a corresponding strip receiving recess formed in the top of said body.

3. The system as claimed in claim 2 wherein at least one of said strips includes an indicium portion indicating at least one of a number or row of said seat and said strip receiving recess is shaped to receive the indicium portion.

4. The system as claimed in claim 1 wherein said opposite ends of said strip are joined together with a fastener having a head shaped to be rotated in only a tightening direction.

5. The system as claimed in claim 1 wherein a rotary mounting interconnects said seat and backrest and includes a damping device to slow the movement of said seat between a substantially horizontal use position and a substantially vertical standby position, wherein said damping device slows the movement of said seat in both directions.

6. The system as claimed in claim 5 wherein said damping device includes a first hollow cylindrical member, a second co-axial cylindrical member retained within said first member and substantially co-extensive therewith, and a helical spring retained between said first and second members, wherein a viscous liquid is trapped between said first and second members and engaged with the turns of said spring.

* * * * *